US005333345A

United States Patent [19]

O'Donnell

[11] Patent Number: 5,333,345

[45] Date of Patent: Aug. 2, 1994

[54] CLEANING IMPLEMENT INCLUDING BRACE OF ELASTOMERIC MATERIAL

[76] Inventor: Jerry L. O'Donnell, 3906 Onawa, Waterloo, Iowa 50701

[21] Appl. No.: 859,818

[22] Filed: Mar. 30, 1992

[51] Int. Cl.[5] ..... A46B 5/00

[52] U.S. Cl. ..... 15/159.1; 15/145; 15/144.1; 403/292; 16/110 R; 16/114 R

[58] Field of Search ..... 15/144.1, 144.2, 159.1, 15/143.1, 176.1, 176.6, 145; 300/21; 403/292, 299, 361, 300, 303; 81/489; 16/110 R, 114 R; 294/57, 58

[56] References Cited

U.S. PATENT DOCUMENTS

| | | | |
|---|---|---|---|
| 288,459 | 11/1883 | Leet | 15/145 |
| 759,490 | 5/1904 | Yates | 15/143.1 |
| 2,559,722 | 7/1951 | Lindstron | 15/143.1 |
| 2,665,441 | 1/1954 | Goon | 15/144.2 |
| 3,315,296 | 4/1967 | Richardson | 15/159.1 |
| 3,371,367 | 3/1968 | Tigerman | 15/145 |
| 4,433,931 | 2/1984 | Malish et al. | 403/361 |
| 4,575,894 | 3/1986 | Stevens et al. | 15/176.5 |
| 4,718,666 | 1/1988 | O'Donnell | 272/137 |
| 4,722,634 | 2/1988 | Malish | 403/299 |
| 4,763,377 | 8/1988 | Madsen | 15/144.2 |
| 4,852,873 | 8/1991 | O'Donnell | 272/137 |
| 5,161,278 | 11/1992 | Tomm | 403/299 |

FOREIGN PATENT DOCUMENTS

| | | | |
|---|---|---|---|
| 9108084 | 6/1991 | World Int. Prop. O. | 15/159.1 |

*Primary Examiner*—Timothy F. Simone
*Assistant Examiner*—Gary K. Graham
*Attorney, Agent, or Firm*—Zarley, McKee, Thomte, Voorhees, & Sease

[57] ABSTRACT

A broom brace for attachment between a broom handle and a broom head. A flexible but resilient elastomeric member is positioned intermediate the broom head and the main portion of the handle. Connecting members allow the handle and broom head to be connected to the flexible member. Portions of the connecting members can be encapsulated within the elastomeric material forming the flexible member.

17 Claims, 4 Drawing Sheets

CLEANING IMPLEMENT INCLUDING BRACE OF ELASTOMERIC MATERIAL

BACKGROUND OF THE INVENTION

1. Field of Invention

The present invention relates to brooms, and in particular, to push brooms.

2. Problems in the Art

Traditional broom handles consist of a straight elongated rod or pole having one end connected to a broom head. The handles are usually made of solid wood or tubes that are metal. The handle is therefore rigid and is generally connected in a rigid matter to the broom head.

Push brooms generally have a wide head with bristles extending downwardly from the head. The handle is generally connected at an angle at the middle of the head and extends backwards from the head. The broom can then be pushed forwardly and in front of the user.

The rigid nature of such a broom can cause difficulties. A primary example is where one end of the broom strikes a rigid object. A considerable jolt can be felt by the user and substantial twisting action can either be detrimental to the user or damage or break the broom.

A real need has therefore been identified in the art for an improvement to brooms.

It is believed that attempts have been made to solve some of the deficiencies or problems in the art. Some long-handled tools such as rakes utilize some sort of a brace such as a spring connected between the tines of the rake and the rake handle to give it some resilience. Additionally, some brooms utilize rigid braces between handle and head or braces such as a metal coil spring between the handle and the head to allow the broom head some resilience and flexibility.

These types of brooms, however, have certain deficiencies. First, a tightly coiled spring can pinch skin or grab clothing. Metal springs are subject to corrosion. They also may degrade in performance over time and can take a set if flexed too far.

It is therefore a principle objective of the present invention to provide a broom brace which improves over the state of the art.

Another object of the present invention is to provide a broom brace which provides flexibility to a broom brace and broom head.

Another object of the present invention is to provide a broom brace which provides a firm but flexible broom brace-broom head combination.

A still further object of the present invention is to provide a broom brace which allows the broom head to contour around objects with reduced risk of damage or breakage to the broom. Another object of the present invention is to provide a broom brace which absorbs shock and redûces shock and fatigue to the user.

A still further object of the present invention is to provide a broom brace which provides flexible yet resilient operation yet is durable, economical, and efficient.

These and other objects, features, and advantages of the present invention will be come more apparent with reference to the accompanying specification and claims.

SUMMARY OF THE INVENTION

The present invention includes a broom brace for use with a broom handle and head. In one embodiment the broom brace comprises a flexible member which is positioned between two portions of the broom handle along the longitudinal axis of the handle, or between the handle and the broom head. More than one flexible member can also be used.

The flexible member is made of an elastomeric material and encapsulates at least part of two connection means. One connection means is positioned at or in one end of the flexible member of the broom brace, and is also adapted to connect to or be one of the portions of the broom handle, and in turn is releasably connected to the broom head. The other connection means is positioned at or in the other end of the flexible member and is adapted to receive the other portion of the broom handle, which can be gripped by the user to manipulate the broom.

The connection means are such that they grip or secure the two portions of the handle and disallow axial movement of either handle portion with respect to the flexible member.

The two handle portions are also secured sufficiently to the flexible member and broom head to resist rotational movement with respect to one another. The combination therefore is connected together. However, the flexible member allows the two portions of the handle to resiliently flex with respect to one another out of normal axial alignment, or even slightly rotationally but resiliently translate or twist with respect to one another along the axis. They can also simultaneously flex and twist to a degree.

DETAILED DESCRIPTION OF PREFERRED EMBODIMENT

Figure 1:
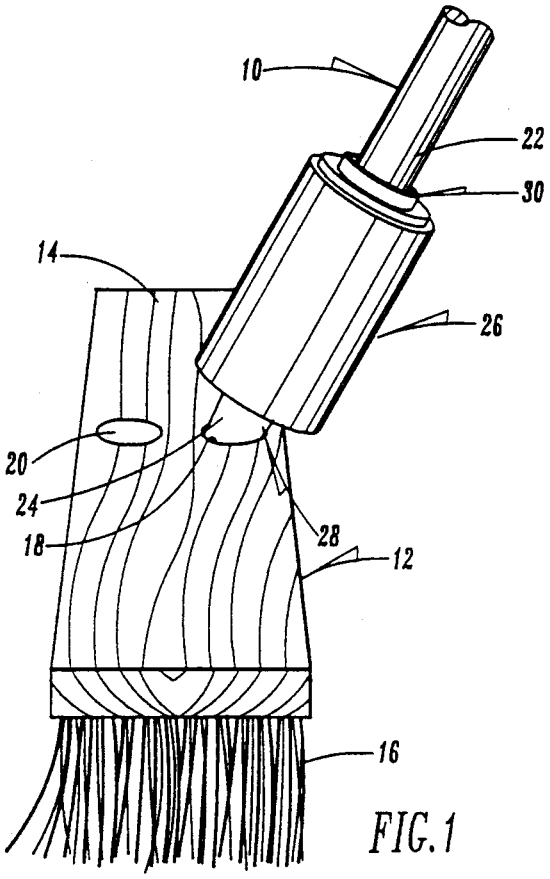
FIG. 1 is a partial perspective view of a broom brace according to the present invention as inserted between portions of a broom handle which in turn is attached to a broom head.

To assist in an understanding of the invention, a preferred embodiment of the invention will now be described in detail. The accompanying drawings will be referred to. Reference numbers on the accompanying drawings and in this description refer to specific parts and locations in the drawings. The same reference numbers will be used to identify the same parts and locations unless otherwise indicated.

FIG. 1 depicts in perspective a broom handle, designated generally by reference numeral 10, and a broom head, designated generally by reference number 12. Broom head 12 includes a base 14 and bristles 16. Angled connection holes 18 and 20 in base 14 allow broom brace 10 to be connected with broom head 12. It is to be understood that connection holes 18 and 20 can be threaded, tapered, or otherwise configured to receive and secure the end of broom brace 10.

FIG. 1 shows that the broom handle comprises an upper or proximal portion 22, a lower or distal portion 24, and a broom brace or flexible member 26 between portions 22 and 24. The words proximal and distal refer to the general orientation of those portions of with respect to where the user would grip the handle 10.

Flexible member 26 is an elastomeric member and includes connection members 28 and 30 at opposite ends. Members 28 and 30 serve to connect flexible member 26 to the proximal and distal portions 24 and 26 of handle 10 respectively.

Figure 2A:
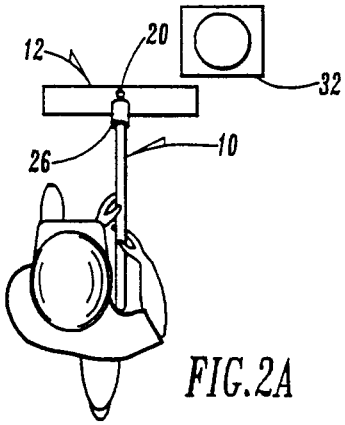
FIGS. 2A–2D are diagrammatic illustrations of the flexibility, and resilience of the embodiment of FIG. 1.
Figure 2B:
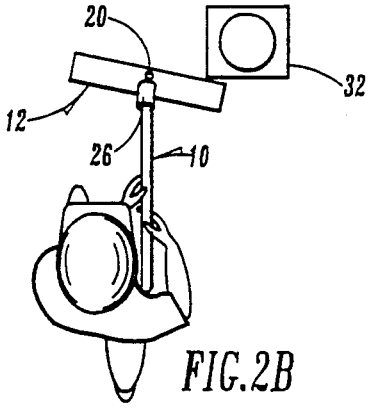

FIGS. 2A–2D illustrate one of the advantages of the present invention. In FIG. 2A a user gripping the proximal portion 22 of handle 10 approaches a rigid object 32 on the floor. FIG. 2B shows that when the right side of the broom head 12 impacts object 32 head 12 flexes by slightly twisting and bending. The user's hands, however, do not rotate or bend as much as they would with the conventional handle and broom head. Still further, a significant amount of the shock is absorbed by flexible member 26.

Figure 2C:
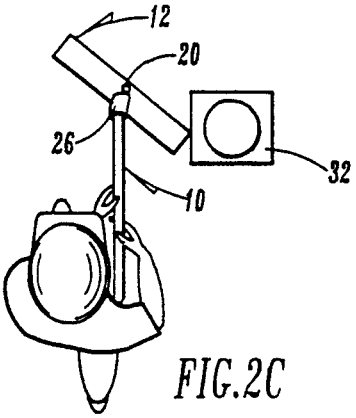
Figure 2D:
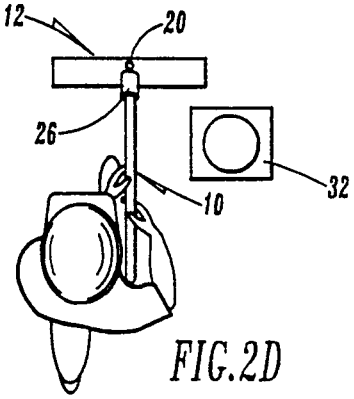

FIG. 2C illustrates that as the user moves forward, broom head flexes and contours around the object 32 until it quickly and firmly snaps back into regular position as shown in FIG. 2D. This allows firm, predictable, and reliable control of the broom while going around object 32 as well as diminishing the effect of obstructions or impedances to the user while sweeping. It also helps maintain the broom in contact with floor even though the object 32 was encountered, and quickly returns the broom head to original position.

While FIGS. 2A–2D illustrate one example of the advantages of the invention, it is to be understood that this operation also serves to reduce operator fatigue, reduces broken handles or broom heads, extends broom head life, and can enhance the even wearing of broom bristles. It also contributes significantly to reduction in injury or trauma to the user as well as broken handles for brooms. It allows firm yet flexible control of a broom.

Figure 3:
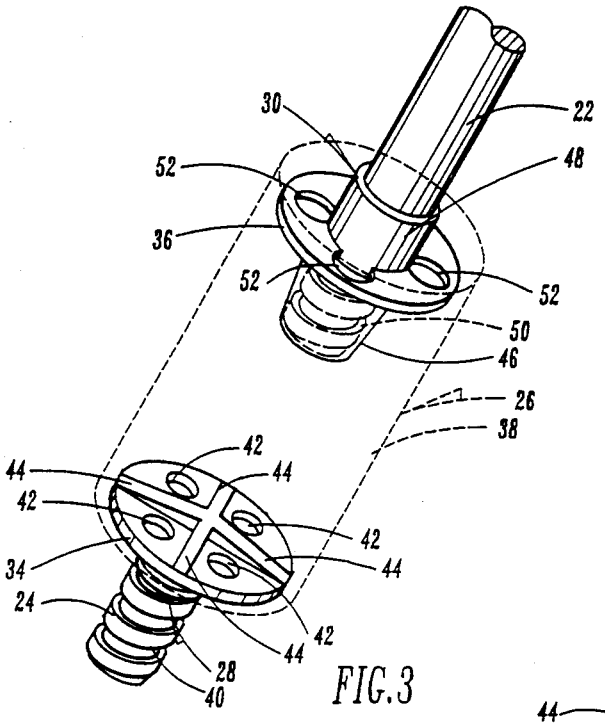
FIG. 3 is an enlarged isolated perspective view of a flexible member, shown in ghost lines, connection means, and portions of the broom handle according to one embodiment of the invention.
Figure 4:
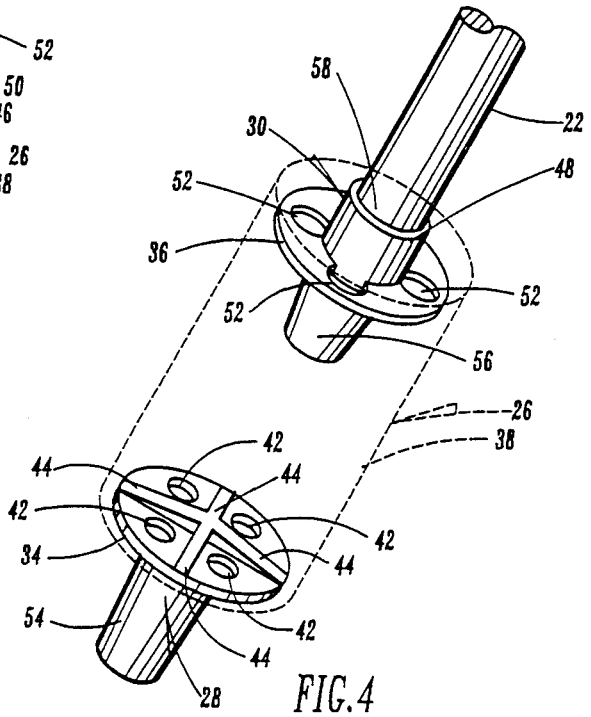
FIG. 4 is similar to FIG. 3 but showing an alternative embodiment of the invention.
Figure 5:
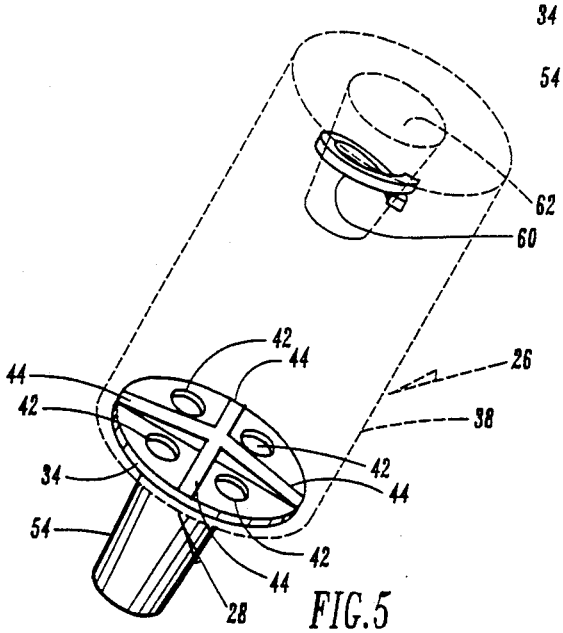
FIG. 5 is similar to FIGS. 3 and 4 but showing a still further alternative embodiment of the present invention.

FIGS. 3–5 depict different embodiments of flexible member 26 and the manner in which handle 10 is connected to flexible member 26. It is to be understood that these are illustrative of such connections that are not comprehensive of the ways in which it can be accomplished.

FIG. 3 illustrates flexible member 26 where connection members 28 and 30 include flanges 34 and 36 respectfully. Each flange 34 and 36 is circular and is encapsulated within the elastomeric body 38. Connection member 28 also includes a threaded male end 40 extending out of body 38. End 40 therefore comprises not only the connection to broom head 12 (which would have a corresponding threaded female hole or holes), but also comprises the distal portion 24 of handle 10. It is noted that in FIG. 3 the flange 34 of connection member 28 is circular and disk shaped extending generally radially from a longitudinal axis through body 38. It also includes a plurality of apertures 42 separated by raised portions 44 which helped maintain connection member 28 securely within the molded body 38. When molded, the material of body 38 sets up through apertures 42 and around raised portions 44. Any rotational movement between connection member 28 and body 38 is therefore deterred.

FIG. 3 shows that connection member 30 at the opposite end of body 38 includes a threaded female receptor having an outer end 48 extending out of body 38 to receive threaded male end 50 of proximal portion 22 of handle 10. Similar to flange 34, flange 36 of connection member 30 is encapsulated in body 38 and includes apertures 52. It could also have raised portions like portions 44.

The configuration of FIG. 3 therefore securely holds connection members 28 and 30 relative to body 38. The inherent nature of body 38, however, allows flexure and twisting of connection members 28 and 30 with respect to one another to an extent. The resilient forces of body 38 always urge members 28 and 30 back to an original position.

FIG. 4 is similar to FIG. 3 except in the following respects. Connection member 28 includes a tapered male end 54, instead of a threaded end which is insertable into suitable tapered holes in broom head 12. Again, tapered male end 54 also comprises the distal portion 24 of handle 10.

On the other hand, connection member 30 includes a tapered female receptor 56 in place of a threaded female receptor, in turn receiving and securing a tapered male end 58 of proximal portion 22 of handle 10.

FIG. 5 is similar to FIGS. 3 and 4. Connection member 28 can be as shown in either FIGS. 3 and 4 (or could be of another configuration). Alternative connection member 30 would simply be the location of a lock washer 60 surrounding a center bore 62 in one end of body 38. Lock washer 60 would take the place of connection member FIG. 3 in that it would receive a male threaded end for proximal portion 22 of handle 10.

It can therefore be seen that the present invention meets at least all of its stated objectives. The preferred embodiment is given by way of example only and not limitation. The true essence and spirit of the invention are defined in the appended claims.

It is to be understood that the invention can take on different forms and embodiments. For example, connection members 28 and 30 could be differently configured. Still further, in the preferred embodiment body 38 is made of a urethane material. Instead of threaded or taper fit connections, handle portions 22 and 24 could be bonded to body 38. For example, if handle 10 was plastic, certain adhesives could bond a plastic handle to a urethane body member 38.

FIGS. 6–9 illustrate additional possible embodiments for the present invention. They are similar to those previously described except for the following differences.

Figure 7:
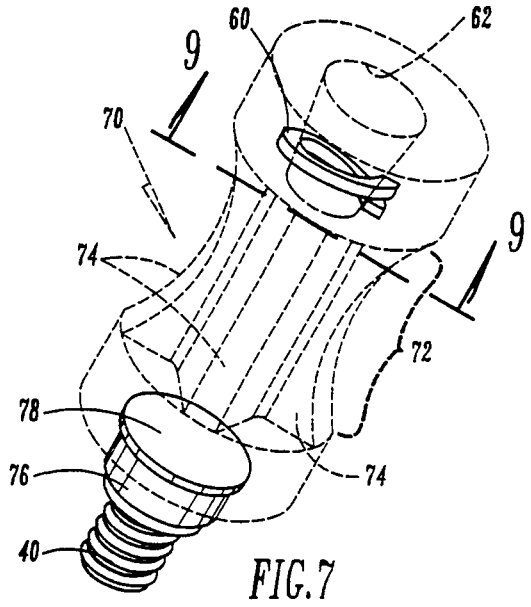
FIG. 7 is a perspective view, partially in ghost lines, another embodiment of the present invention.
Figure 8:
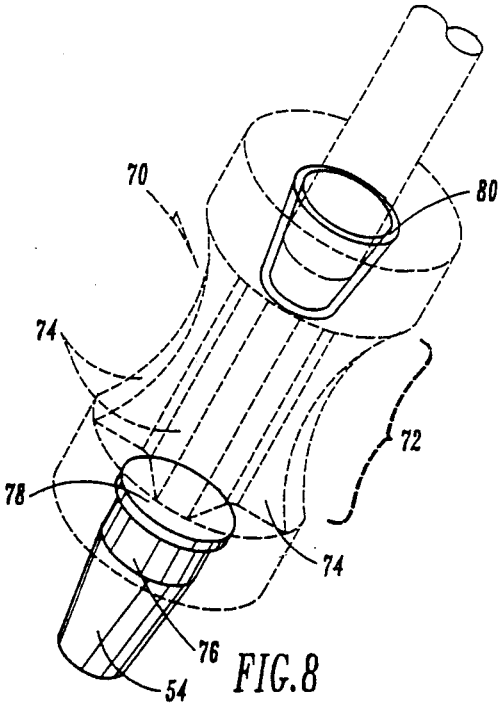
FIG. 8 is a perspective view, partially in ghost lines, of a still further embodiment of the present invention.
Figure 9:
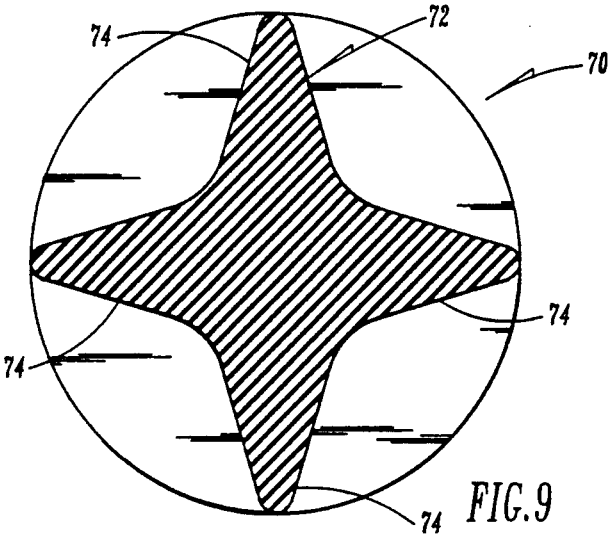
FIG. 9 is a sectional view taken along line 9—9 of FIG. 7.

Each of FIGS. 6–9 illustrates an elastomeric body member 70 similar to body member 38 of the preceding drawings except that it has a portion between opposite ends that is molded to be of the shape shown in cross-section in FIG. 9. This central portion 72 is comprised of four radial ribs 74. Body member 70 can be molded in one unitary piece.

Figure 6:
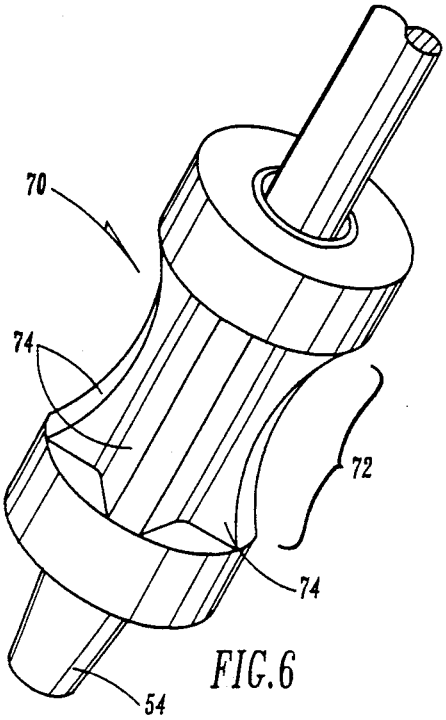
FIG. 6 is a perspective view of an alternative embodiment of the flexible member for the present invention.

FIG. 6 illustrates that one end of body member 70 can include a male connection member 54, which is similar to connection member 28 in FIG. 4 or FIG. 5, is tapered and could be force fit into a connection hole 18 or 20 in broom brace 14 as shown in FIG. 1. Similarly, a female connection member 80 could be molded into the opposite end of body member 70. It could be tapered such as shown in FIG. 4 to receive the tapered end of the broom handle.

FIG. 7 shows that body member 70 could alternatively have a threaded male end 40 as its connection member 28 (similar to FIG. 3) or a lock washer 60 molded around a bore 62 in its opposite ends, to receive the threaded end of the broom handle 10, similar to shown in FIG. 5. It is noted that body member 70 is shown in ghost lines in FIG. 7 to depict the shape of that particular connection member. Threaded male end 40 is connected to a cylindrical portion 76 which extends into body member 70 and terminates in a flange 78 which would secure connection member 28 into body member 70.

FIG. 8 illustrates more specifically the embodiment shown in FIG. 6 where tapered male end 54 of connection member 28 is also attached to a cylindrical portion 76 and flange 78 which secures the connection member in body member 70. FIG. 8 also depicts how a rigid durable tapered sleeve 80 could be molded into the top part of body member 70 to receive the tapered end of broom brace 10.

Other examples of different forms, configurations, and parts an invention can take are shown in FIGS. 10–14. These alternatives are by no means inclusive but are examples of different forms and embodiments.

Figure 10:
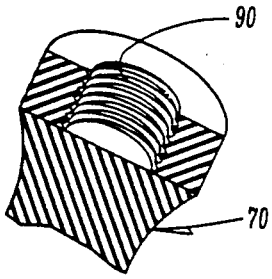
FIG. 10 is an enlarged partial perspective, partial cutaway view of a flexible member such as shown in FIG. 6 with a different connection means according to the present invention.

FIG. 10 shows body member 70 such as previously described, with one significant difference. Instead of a separate piece molded into or inserted into body member 70 to form a connection member, the end of body member 70 itself can be threaded (see threads 90) to receive the male threaded end of handle portion 22 as shown in previous drawings. Such threading is possible with certain elastomeric materials such as urethane.

It is also to be understood that various materials can be utilized to make the flexible member. Urethane is one example only. Some plastics having memory (to make them resilient) can be used such as "torlon" which can be obtained from DuPont. Glass-filled nylon and other materials are also possible.

Figure 11:
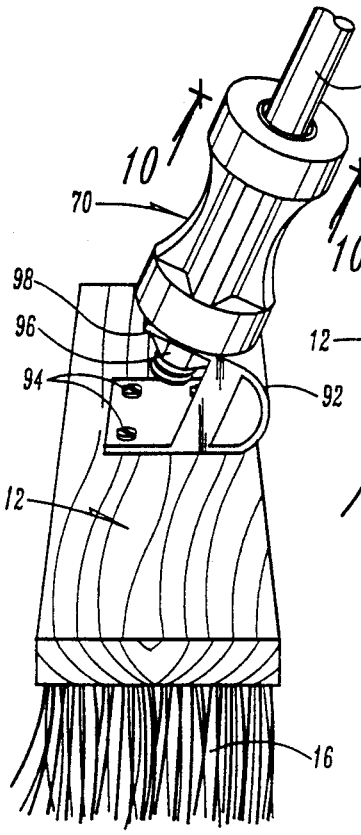
FIG. 11 is a perspective view of an alternative connection means between flexible member and broom brace.
Figure 12:
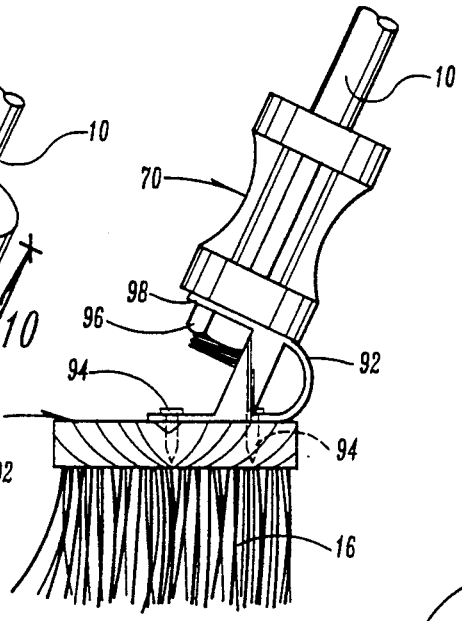
FIG. 12 is a side elevational view of FIG. 11.

FIGS. 11 and 12 show an alternative embodiment for connecting flexible member 70 to broom head 12. Previous embodiments have utilized some type of hole or aperture (whether tapered or threaded) in broom head 12 to secure a lower connection member to broom head 12. Instead, FIGS. 11 and 12 show a bracket 92 that can be secured to broom head 12 by screws 94 or other fastening means, which do not require making the aperture in broom head 12.

Bracket 92 is attached to flexible member 70, in this embodiment, by molding a threaded male connection member, perhaps such as shown in FIG. 7 at numeral 24, or FIG. 7 at numeral 40, into the bottom of flexible member 70. A nut 96 can then be tightened down on the male threadable member which extends through an aperture (not shown) in bracket piece 98, to secure bracket 98 to flexible member 70.

Figure 14:
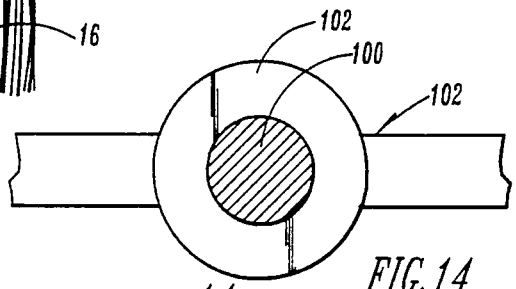
FIG. 14 is a sectional view taken along line 14—14 of FIG. 13.
Figure 13:
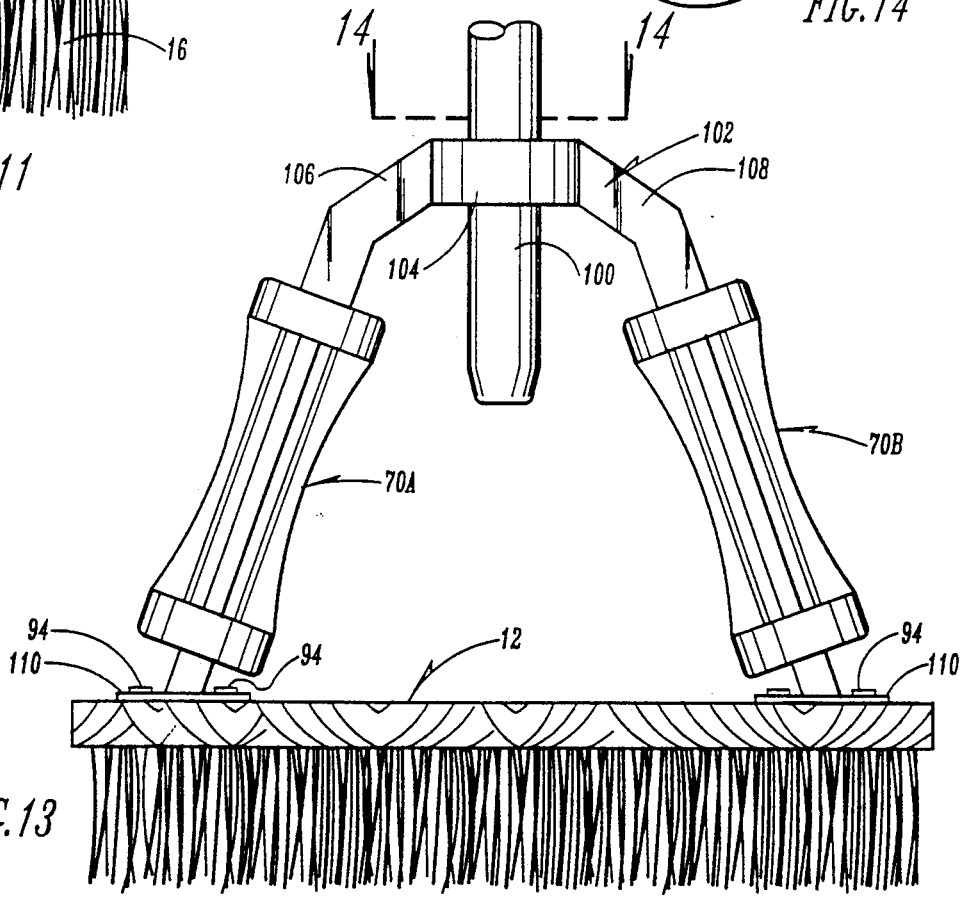
FIG. 13 is a front elevational view of a still further embodiment of the present invention.

FIGS. 13 and 14 shown an alternative embodiment for the invention. Instead of having the flexible member positioned along the axis of the broom handle, the following configuration might be used. A broom handle 100 could be inserted and secured in an upper bracket 102 which includes a cylindrical portion 104 and arms 106 and 108.

Two flexible members 70A and 70B would be secured at one end to the outer ends of arms 106 and 108. The connection between 70A and 70B and the arms 106 and 108 can be any one of the connections previously mentioned, or perhaps directly molded into members 70A and 70B, or other configurations.

Likewise, the other ends of members 70A and 70B can be connected to broom head 12 by any of the foregoing ways, including utilizing plates 110 and screws 94 for the actual connection to broom head 12.

It will be appreciated that the present invention can take many forms and embodiments. The true essence and spirit of this invention are defined in the appended claims, and it is not intended that the embodiment of the invention presented herein should limit the scope thereof.

Other forms and embodiments are possible. It is to be specifically understood that the connection members could be tapered or threaded, or any combination of the same. Additionally, other types of connections through the elastomeric body member are possible.

What is claimed is:

1. A handled household and industrial cleaning implement comprising:
   - an implement head;
   - a handle for gripping and maneuvering by a user of the implement; and
   - a flexible and resilient member connected between the handle and the head for allowing resilient flexure and twisting displacement of the handle relative to the head, the flexible and resilient member being made of an elastomeric material;
   - a connection member secured at one end to the flexible and resilient member and having a portion for removable connection to the head, the connection member including a flange encapsulated within the elastomeric material to anchor the connection member in the elastomeric material.

2. The implement of claim 1 wherein one said connection member includes a receptacle for seating and securing the handle.

3. The implement of claim 2 wherein the receptacle includes a securing device.

4. The implement of claim 3 wherein the securing device includes a threaded portion.

5. The implement of claim 3 wherein the receptacle includes a tapered portion.

6. The implement of claim 3 wherein the receptacle includes at least one of a threaded portion and a tapered portion.

7. A broom, having a head with bristles and a handle, made by the process of:
   - encapsulating a portion of a connection member in each end of an elongated elastomeric material;
   - releasably connecting the handle in one connection member and releasable connecting the head to the other connection member;

so that the broom is substantially rigid yet resilient regarding forces tending to displace the head relative to the handle.

8. The broom of claim 7 wherein the portion of each connection member is encapsulated by molding the elastomeric material around said portion of said connection member.

9. The broom of claim 8 wherein the elastomeric material has a general longitudinal axis and the portion of each connection member includes a flange having portions extending generally transversely of the longitudinal axis of the elastomeric material.

10. The broom of claim 9 wherein at least one flange includes apertures through which the elastomeric material is molded.

11. The broom of claim 10 wherein at least one flange includes portions extending generally parallel to the direction of the longitudinal axis of the elastomeric material.

12. A broom comprising:

a broom head for carrying broom bristles, the broom head including a base with bristles extending from the base;

a generally straight broom handle for gripping and maneuvering by a user of the broom; and a flexible member having generally opposite ends positioned between the broom handle and the broom head for allowing resilient flexure and twisting displacement of the broom handle relative to the broom head, the flexible member being made of an elastomeric material and including connection members for connection of the flexible member to the broom head and broom handle, the connection members including flanges encapsulated within the elastomeric material to anchor the connection members in the elastomeric material, the broom handle extending generally from one opposite end of the flexible member, the flexible member being positioned generally near the broom head.

13. The broom of claim 12 wherein one said flange is connected to a receptacle for seating and securing said broom handle.

14. The broom of claim 13 wherein the receptacle includes a securing member.

15. The broom of claim 14 wherein the securing member includes a threaded portion.

16. The broom of claim 14 wherein the receptacle includes a tapered portion.

17. The broom of claim 14 wherein the receptacle includes at least one of a threaded portion and a tapered portion.

* * * * *